United States Patent [19]

Wichinsky

[11] 4,455,846

[45] Jun. 26, 1984

[54] SECURITY LOCK FOR COIN OPERATED MACHINES

[76] Inventor: Louis Wichinsky, Hurleyville, N.Y.

[21] Appl. No.: 432,990

[22] Filed: Jan. 10, 1983

[51] Int. Cl.[3] ..... E05B 65/00

[52] U.S. Cl. ..... 70/94; 292/259 R

[58] Field of Search ..... 70/423, 424, 91, 94, 70/99, 159, 45, 46, 32, 38 B, 162–164, 166, 170; 292/96, 259, 101, 106, 67, 71

[56] References Cited

U.S. PATENT DOCUMENTS

| | | | |
|---|---|---|---|
| 2,419,013 | 4/1947 | Ducey | 70/38 B |
| 3,919,807 | 11/1975 | Mefford | 292/259 X |
| 4,067,598 | 1/1978 | Mansour | 292/259 R |
| 4,186,843 | 2/1980 | Omori | 70/164 X |
| 4,286,810 | 9/1981 | Ehmen | 292/67 |
| 4,330,147 | 5/1982 | Nolen | 292/259 R |

*Primary Examiner*—Gary L. Smith
*Assistant Examiner*—Thomas J. Dubnicka
*Attorney, Agent, or Firm*—Lawrence S. Lawrence

[57] ABSTRACT

A locking device for securing the coin box of coin operated vending and amusement machines is provided. An elongated flat locking bar is pivotally connected to the face of the coin operated machine by means of a spring loaded pivot pin for swinging movement parallel to said face between a locking position extending across and in close juxtaposition to the access door of the coin box and an open position permitting access to said door. A locking pin extends through an opening in the free end of the locking bar and a corresponding opening formed in the face of the machine to a point on the interior of said machine adjacent to the coin box. A barrel lock normally provided to lock the access door of the coin box is fitted with a lever having a retaining notch formed therein which is adapted to engage the inner end of the locking pin in its locked position. Access to the barrel lock from the exterior of the coin operated machine is obtained by a suitable opening formed in the locking bar. The spring loaded pivot pin biases the locking bar into contact with the access door in the locked position.

9 Claims, 6 Drawing Figures

SECURITY LOCK FOR COIN OPERATED MACHINES

BACKGROUND OF THE INVENTION

With the increased popularity of video games and public arcades in which such games and other coin operated machines are available for use, the problems of security have become quite severe. Video games, vending machines and other coin operated machines in general are manufactured with an access door or drawer on the exterior of the machine which contains or conceals the coin box. Such door or drawer is often provided with a key operated barrel lock. Unfortunately, little security is provided in this manner, since such locks can be pried open resulting in numerous break-ins. To overcome this problem, manufacturers and arcade operators, as well as vending and gaming machine companies in general, have provided additional locking mechanisms which extend across the face of the access door or drawer containing the coin box to provide additional security. These devices often take the form of an elongated flat metallic bar secured in place by one or more padlocks. While this is undoubtedly more effective then merely a barrel lock on the coin box, it does not completely eliminate break-ins, since the bar often does not fit snugly against the access door and exposed segments of the locking device can be easily hacksawed or sheared.

In addition, the use of external padlocks is somewhat inconvenient due to the necessity of operating personnel maintaining additional keys for each machine.

SUMMARY OF THE INVENTION

In accordance with the present invention, a locking device for securing the coin box of coin operated vending and gaming machines is provided which overcomes the deficiencies found in prior locking devices and provides increased security. The present invention utilizes, enhances and protects the barrel lock of the machine to which it is attached and thereby eliminates the need for external padlocks. This reduces the likelihood of break-ins and simplifies the management of multiple machines by reducing the number of keys that are necessary to gain access to the coins.

In general, the locking device of the present invention comprises an elongated flat bar (referred to herein as a locking bar and/or a security bar) pivotally connected to the coin operated machine by means of a spring loaded pin for swinging movement parallel to the surface of the machine between a locked position extending across and in close juxposition to the access door or drawer of the coin box, and an open position fully exposing said door or drawer; a locking pin having a flange at one end and a groove at the other end connected to the distal end of the locking bar and extending through an opening formed in the face of the coin operated machine to a position adjacent the coin box; a barrel lock disposed within said door or drawer accessable on the exterior of the machine through a suitable opening formed in the locking bar; and a locking lever having a retaining notch formed adjacent one end thereof connected to the interior of the barrel lock and adapted for pivotal movement therewith between a locked position in which the retaining notch engages the groove on the locking pin to secure both the locking bar and the door or drawer in a locked position, and an open position disengaging the locking pin to permit the locking bar to be moved into its open position and to permit the door or drawer to be opened.

The spring loaded pin which pivotally connects the locking bar to the face of the machine extends through a suitable opening formed in one end of the locking bar and through a corresponding opening in the face of the machine. A compression spring is disposed about the pin on the interior of the machine and is held in place by a retaining nut, thus biasing the locking bar inwardly into contact with the face of the machine and the door or drawer which it secures. The spring also permits a slight amount of lateral movement of the bar away from the face of the machine to permit the bar to pass over protrusions extending from said face during its movement between its open and locked positions. However, the force of the spring is designed to minimize play between the access door and the locking bar in the locked position, which could otherwise permit the door to be pried open without disturbing the locking bar.

The close contact between the bar and the face of the machine is also maintained by the engagement of the locking lever on the barrel lock and the locking pin, since such lever serves the dual purpose of securing both the door and the locking bar in their locked position. To insure such close contact it is preferable that the size of the groove on the locking pin be made adjustable and that the locking pin be retained within the machine in a fixed horizontal and vertical position relative to the barrel lock, so that the groove may be properly aligned with the locking lever. The groove adjustability can be accomplished by forming a circumferential groove defined by a flanged bolt or stud adapted to threadably engage the inner end of the locking pin. Rotation of the bolt or stud properly adjusts the size of the groove. The proper position and retention of the locking pin can be accomplished by fixedly connecting the pin to the locking bar by press fitting the same in a suitable opening formed in the locking bar, by welding the pin in place or any other suitable means of connection. Alternatively and preferably, an elongated sleeve is fixedly connected to the bar in alignment with a corresponding opening formed in said bar. The pin slidably engages the sleeve and is thereby held in a fixed horizontal and vertical position relative to the barrel lock.

Barrel locks are often flange mounted relatively flush with the surface of the door or the drawer to which they are attached. The locking bar is adapted in its locked position to extend over the barrel lock and to provide access to such lock through a suitable opening located adjacent to the keyhole thereof. Preferably the access opening is smaller than the flange of the barrel lock, so that the locking bar exerts an inward force against the flange to prevent the same from being pried loose.

The installation of the locking device of the invention on a conventional vending or gaming machine is quite simple. It merely requires the drilling of two openings to accept the pivot pin and the locking pin, respectively. In addition, the barrel lock must be slightly modified by the removal of the conventional locking lever which is adapted merely to engage the door frame, its replacement by the locking lever in accordane with the invention containing the retaining notch adapted to engage the groove on the locking pin. If required the locking bar of the invention can be formed with additional openings to provide access to coin slots or coin return buttons if the same are located beneath the bar in its locked position.

The locking device of the present invention is described in more detail in the drawings which are annexed hereto.

DETAILED DESCRIPTION OF PREFERRED EMBODIMENT

Figure 1:
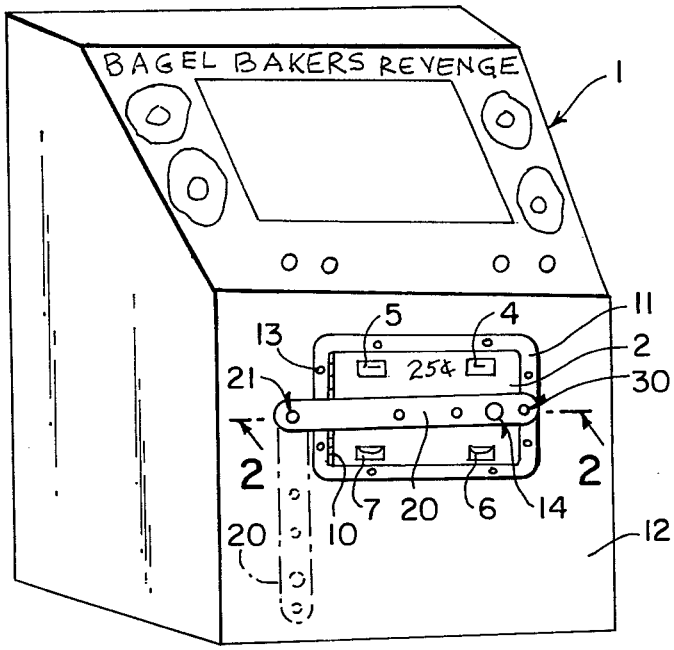
FIG. 1 is a front perspective view of a coin operated arcade type video game employing the locking device of the invention.

FIG. 1 illustrates a coin operated video game 1 of the type that might be found in the multitude of arcades that have experienced recent popularity. While the invention will be described with reference to this particular illustrative machine it is intended for use with any gaming or vending machine which is coin operated, all of which are well known and need not be described in detail herein.

The machine 1 has a door 2 disposed on the front face thereof. Such door conceals and encloses a coin box 3 which is shown in phantom in FIG. 2. In the illustration shown, the door 2 has two coin slots 4 and 5 and two coin return slots 6 and 7. In addition, two coin return buttons 8 and 9 shown in FIG. 2 are also disposed in door 2.

Door 2 is pivotally connected by a hinge 10 to a metallic frame 11. Frame 11 in turn is disposed within an opening formed in the front wall 12 of the video game machine 1, and is fixedly connected to said front wall by means of a series of rivets or similar fastening devices 13. The door 2 is adapted to open outwardly to provide access to the coin box 3. It is prevented from moving to the interior of the machine 1 by suitable stops well known in the art, which are not shown. To secure the door 2 in a closed position, a key operated barrel lock 14 is disposed in a suitable opening formed in the door. The lock 14 has an external flange 15, which bears against the outer surface of door 2, and a nut 16, which threadably engages the body of the barrel lock and bears against the inner surface of door 2 to secure the lock firmly in place.

Figure 2:
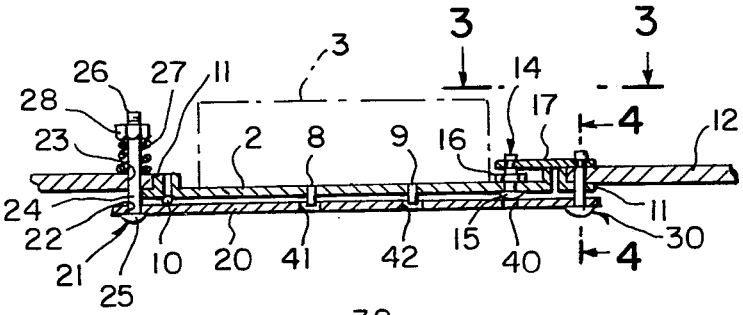
FIG. 2 is a cross-sectional view taken along the line 2—2 of FIG. 1.
Figure 3:
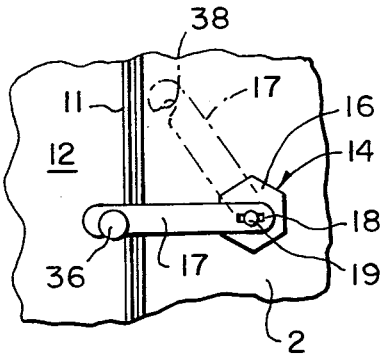
FIG. 3 is a partial interior view of the locking device taken along the line 3—3 of FIG. 2

Referring to FIGS. 2 and 3 a lever 17 is fixedly connected to the inner end of barrel lock 14. The lever 17 is formed with a slotted opening 18 which engages a corresponding tongue formed at the end of the barrel lock, and is held in place by a screw or other fastening device 19, which engages the end of the tongue. The lever 17 is pivotally movable together with the key operation of the barrel lock 14 between an open position indicated by the phantom lines in FIG. 3 and a closed position indicated by the solid lines in FIG. 3. As shown, in the closed position the lever engages the inner surface of frame 11 and front wall 12 to prevent the door 2 from opening.

The locking device of the invention comprises an elongated flat steel bar 20, which is pivotally connected to the front wall 12 of the machine 1 and swingable between a closed position extending across the front of door 2 as shown by the solid line in FIG. 1, and an open position shown by the phantom line in such figure which permits door 2 to be opened. Bar 20 is pivotally connected to the front wall 12 by means of a pivot pin 21, which extends through an opening 22 formed at one end of bar 20 and a corresponding opening 23 formed in front wall 12. Pivot pin 22 comprises a cylindrical shaft 24, an external flange 25 which engages the outer surface of bar 20 and a threaded inner end 26. A helical compression spring 27 is disposed about shaft 24 and is held in place by a nut 28 which threadably engages the threaded end 26 of pin 21 and abuts the cylindrical shaft 24. Spring 27 biases the pivot pin and bar 20 inwardly into contact with the outer face of door 2 in its closed position.

Figure 5:
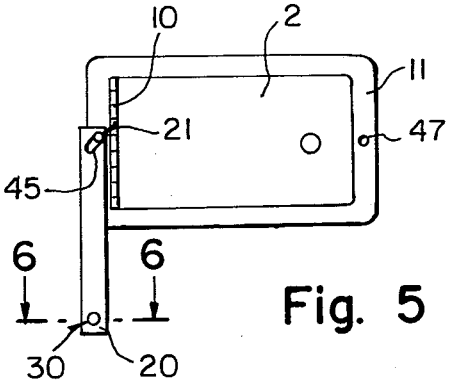
FIG. 5 is a front view of an alternative embodiment of the locking device of the invention.

In some instances, particularly where the walls of machine 1 are constructed of wood, it is preferable to connect bar 20 to the frame 11, rather than the front wall 12 of the machine, to provide increased strength. When this is done, as shown in FIG. 5, the bar 20 is formed with a diagonally disposed slot 45 adapted to receive pivot pin 22. Since frame 11 is relatively narrow, the purpose of slot 45 is to permit sliding movement of bar 20 away from door hinge 10, so that the bar will not obstruct the opening of door 2.

Figure 4:
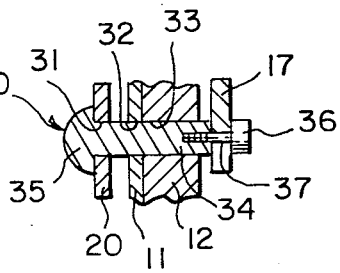
FIG. 4 is an enlarged cross-sectional view taken along the line 4—4 of FIG. 2.
Figure 6:
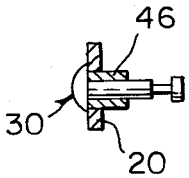
FIG. 6 is an enlarged cross-sectional view taken along the line 6—6 of FIG. 5.

An adjustable locking pin assembly 30 is disposed at the free end of bar 20, and is best seen in FIGS. 2 and 4. Locking pin 30 is press fit within an opening 31 formed in bar 20 and extends through openings 32 and 33 formed in door frame 11 and front wall 12, respectively. The locking pin assembly 30 comprises a cylindrical shaft 34 which engages the aforesaid openings; and an external flange 35 which engages the outer surface of bar 20. An adjustable screw 36 threadably engages the inner end of shaft 34 so as to define therewith a circumferential groove 37. The width and end point of such groove is adjustable by rotatably fixing the position of screw 36. By press fitting pin 30 in place its horizontal and vertical position relative to barrel lock 14 remains relative constant and insures proper alignment of groove 37 with locking lever 17. Alternatively, as shown in FIG. 6, a sleeve 46 is fixedly connected by press sitting or otherwise to bar 20. Such sleeve is adopted to slidably receive locking pin 30. This permits the removal of the pin, but insures its proper alignment within the machine 1. In this embodiment an opening 47 is formed in frame 11 to receive sleeve 46 in the locked position of bar 20. To secure the locking pin assembly and in turn the locking bar 20 in its locked position lever 17 is formed with a retaining notch 38. In the closed position of the barrel lock, lever 17 is moved to the solid position shown in FIG. 3 and retaining notch 38 engages the circumferential groove 37.

To gain access to the exterior of barrel lock 14, the bar 2 is formed with an opening 40 which is aligned with said lock in the locked position of the bar. The opening 40 has a smaller diameter than the diameter of flange 15 of the barrel lock, so that the bar in its closed position engages the surface of flange 15 and in turn biases the same inwardly toward the face of door 2 to more firmly secure said lock in place, and thus prevent it from being pried loose.

Additionally, bar 20 is also formed with openings 41 and 42, which are adapted to accommodate coin return buttons 8 and 9, respectively.

The locking device of the invention is intended in most instances to be installed on existing coin operated machines, although it can be included as original equipment by the machine manufacturer. In the case of a retrofit, the locking lever, which is included in the original manufacture as part of the barrel lock must be replaced with locking lever 17, since in most instances the original lever is shorter, is adapted merely to engage the inner surface of the door frame 11 and does not include the retaining notch 38.

In operation, after the installation of the locking device, the same is utilized by first closing door 2, but leaving lock 14 in a relatively open position. Locking bar 20 is then swingably moved about pivot pin 21 into its closed position extending transversely across door 2. The spring loaded pivot pin permits lateral movement of the bar away from the face of machine 1 so that the same might pass over the coin return slots 6 and 7, the coin return buttons 8 and 9 and any other protuberance that may extend from the face of door 2 or the face of the machine, and still bias the locking bar 20 against door 2 in the closed position. Having moved the bar 20 to the closed position, the locking pin 30 is then inserted and the barrel lock moved to its closed position so that the retaining notch 38 on lever 17 engages groove 37 of the locking pin. The reverse procedure is followed to unlock the locking device and open door 2.

It will be apparent to those skilled in the art that the locking device in the invention can be adapted for use in any coin operated machine wherein an access door or drawer containing or concealing a coin box is provided, and although the invention has been illustrated with respect to a video arcade game, its use is not limited in such fashion. It will also be apparent to those skilled in the art that the length and shape and thickness of the locking bar 20 can be altered to suit the particular machine on which the device is to be installed.

What is claimed is:

1. A security mechanism for locking coin operated vending and gaming machines of the type having a coin box and openable access means for concealing said coin box within the machine comprising, in combination, a flat security bar pivotally connected to the machine adjacent the access means for movement between an open position fully exposing the access means and a locked position extending across and in close juxtaposition to the access means to prevent opening of the same; means for pivotally connecting one end of the security bar to the coin operated machine; means associated with said pivot means for biasing the security bar into contact with the access means in the locked position of said security bar and permitting limited lateral movement of said security bar during its pivotal movement between the open and locked positions; a key operated lock fixedly disposed on the access means having a lever with a notched end connected thereto for movement with the lock between open and locked positions on the interior of the access means; a lock pin connected to the security bar at the end opposite the pivot means; said pin extending into the machine to a position adjacent the access means and having a groove at one end thereof for engagement by the notched end of the locking lever of the key operated lock in its locked position to secure both the access means and the security bar in their locked positions.

2. A security mechanism in accordance with claim 1, in which the means for pivotally connecting the security bar comprises a stud which extends to the interior of the coin operated machine; and the biasing means comprises a compression spring disposed about said stud on the interior of the coin operated machine, and a nut adapted to threadably engage the stud to retain the spring in place.

3. A security mechanism in accordance with claim 1, in which the length and position of the groove on the lock pin is adjustable.

4. A security mechanism in accordance with claim 3, in which the lock pin comprises a stud having a cylindrical shaft with a flange at one end and an internal thread at the other end; and a screw in threadable engagement with said shaft to define an adjustable circumferential groove for receiving the notched end of the lever of the lock.

5. A security mechanism in accordance with claim 1, in which the lock is a barrel lock having an external flange in engagement with the access means; and the security bar has an opening formed therein adapted to be in alignment with said barrel lock to provide access thereto in the locked position of said bar.

6. A security mechanism in accordance with claim 5, in which the opening formed in the security bar is smaller than the flange on the barrel lock and the security bar is held in contact with said flange by the force of the biasing means.

7. A security mechanism for locking coin operated vending and gaming machines of the type having a coin box, an access door for said coin box hingeably mounted for movement between open and closed positions, and a barrel lock fixedly disposed on said door extending to the interior thereof to hold the same in its closed position comprising, in combination, a security bar pivotally connected to the machine adjacent the hinged edge of the access door for movement between a locked position extending transversely across the access door to prevent movement of said door into its open position, and an open position fully exposing the access door; means for biasing the bar in its locked position into contact with the access door; a locking lever having a retaining notch formed therein fixedly connected to the barrel lock for movement therewith between unlocked and locked positions; and a lock pin connected to the security bar at the end opposite its pivotal connection to the coin operated machine and adapted to extend into the machine to a position adjacent the interior of the barrel lock; said pin having a groove adapted to receive the retaining notch of the locking lever in its locked position to secure both the door and the security bar in their locked positions.

8. A security mechanism in accordance with claim 7, further comprising means for biasing the security bar in the locked position into contact with the access door and permitting limiting lateral movement of said bar during its pivotal movement.

9. A security mechanism in accordance with claim 7, in which the lock pin includes means to adjust the size and position of the groove.

* * * * *